US008479318B2

(12) United States Patent
Kim et al.

(10) Patent No.: US 8,479,318 B2
(45) Date of Patent: Jul. 9, 2013

(54) LACROSSE GLOVE HAVING REINFORCED FINGERS

(75) Inventors: Cortland R. Kim, San Francisco, CA (US); Blakeley E. Kim, San Francisco, CA (US); Andrew J. Szurley, Lincoln, RI (US)

(73) Assignee: Easton Sports, Inc., Van Nuys, CA (US)

( * ) Notice: Subject to any disclaimer, the term of this patent is extended or adjusted under 35 U.S.C. 154(b) by 111 days.

(21) Appl. No.: 12/876,019

(22) Filed: Sep. 3, 2010

(65) Prior Publication Data

US 2012/0054942 A1 Mar. 8, 2012

(51) Int. Cl.
*A63B 71/14* (2006.01)
*A41D 19/00* (2006.01)

(52) U.S. Cl.
USPC ..... 2/161.1; 2/16; 2/20; 2/160; 2/161.6; 2/161.2

(58) Field of Classification Search
None
See application file for complete search history.

(56) References Cited

U.S. PATENT DOCUMENTS 4,400,829 A * 8/1983 Willis ..... 2/16
4,441,711 A * 4/1984 Dubar et al. ..... 473/61
4,751,749 A * 6/1988 Cowhey ..... 2/161.1
4,815,147 A * 3/1989 Gazzano et al. ..... 2/161.1
4,858,245 A * 8/1989 Sullivan et al. ..... 2/21
4,864,659 A * 9/1989 Morris ..... 2/20
5,011,053 A * 4/1991 Davies ..... 223/78
5,067,175 A * 11/1991 Gold ..... 2/16
5,373,585 A * 12/1994 Wiggins ..... 2/159
5,398,342 A * 3/1995 Kinnee et al. ..... 2/19
5,572,739 A * 11/1996 Kolada et al. ..... 2/19
5,697,103 A * 12/1997 Wiggins ..... 2/159
5,787,506 A * 8/1998 Wilder et al. ..... 2/161.1
5,884,329 A 3/1999 Goldsmith et al.
5,963,985 A 10/1999 Behr et al.
6,085,354 A * 7/2000 Wilder et al. ..... 2/161.1
6,453,474 B2 * 9/2002 Kleinert ..... 2/161.1
6,543,058 B2 * 4/2003 Litke ..... 2/161.2
6,557,177 B2 * 5/2003 Hochmuth ..... 2/159
6,584,615 B1 * 7/2003 Wilder et al. ..... 2/16
6,634,029 B1 * 10/2003 Sullivano et al. ..... 2/19
6,766,531 B2 * 7/2004 Sullivano et al. ..... 2/19
6,772,441 B2 8/2004 Lucas, Jr.
6,813,781 B2 * 11/2004 Wilder et al. ..... 2/161.1
6,839,912 B2 * 1/2005 Lewis ..... 2/161.6
6,990,689 B1 * 1/2006 Thellmann ..... 2/161.1
7,065,795 B2 * 6/2006 Hochmuth ..... 2/161.1
7,275,268 B2 * 10/2007 Gait ..... 2/161.1
7,313,830 B2 1/2008 Desjardins et al.
7,313,831 B2 * 1/2008 Wilder et al. ..... 2/161.1
7,320,145 B2 * 1/2008 Hochmuth ..... 2/161.1
7,937,774 B1 * 5/2011 King ..... 2/161.1
8,132,269 B1 * 3/2012 Ibon et al. ..... 2/161.1
2002/0013961 A1 * 2/2002 Kleinert ..... 2/16
2002/0040494 A1 * 4/2002 Kleinert ..... 2/161.1
2003/0192104 A1 * 10/2003 Wilder et al. ..... 2/161.1
2003/0221235 A1 * 12/2003 Lewis ..... 2/16
2004/0034899 A1 * 2/2004 Sullivano et al. ..... 2/19

(Continued)

*Primary Examiner* — Bobby Muromoto, Jr.
(74) *Attorney, Agent, or Firm* — Perkins Coie LLP

(57) ABSTRACT

A sports glove, such as a lacrosse or hockey glove, includes reinforced finger regions for protecting a wearer's fingers. The back side of each of the finger regions includes a reinforcing element or other protective feature. A thumb protector may optionally be attached to a thumb region of the glove to provide additional protection for a wearer's thumb, as well.

17 Claims, 3 Drawing Sheets

U.S. PATENT DOCUMENTS

2004/0261155 A1* 12/2004 Agathos et al. ..... 2/161.1
2006/0010552 A1* 1/2006 Gait ..... 2/16
2006/0218689 A1* 10/2006 Brown ..... 2/19
2007/0074332 A1* 4/2007 Wilder et al. ..... 2/161.1
2007/0261149 A1* 11/2007 Gait ..... 2/16
2008/0052799 A1* 3/2008 Yoo ..... 2/16
2008/0060103 A1* 3/2008 Lin et al. ..... 2/19
2008/0060105 A1* 3/2008 Lin et al. ..... 2/19
2008/0313786 A1* 12/2008 Saturnio ..... 2/16
2009/0281470 A1* 11/2009 Sandusky et al. ..... 602/5
2010/0132087 A1* 6/2010 Gait ..... 2/16
2012/0017351 A1* 1/2012 McCrane ..... 2/161.1

* cited by examiner

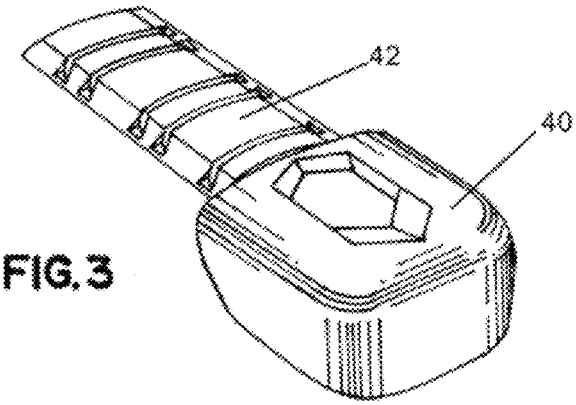
FIG. 3
FIG. 4
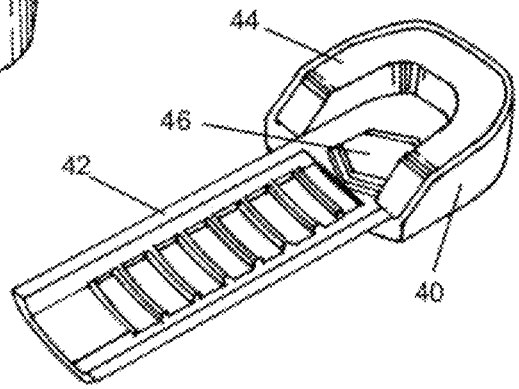
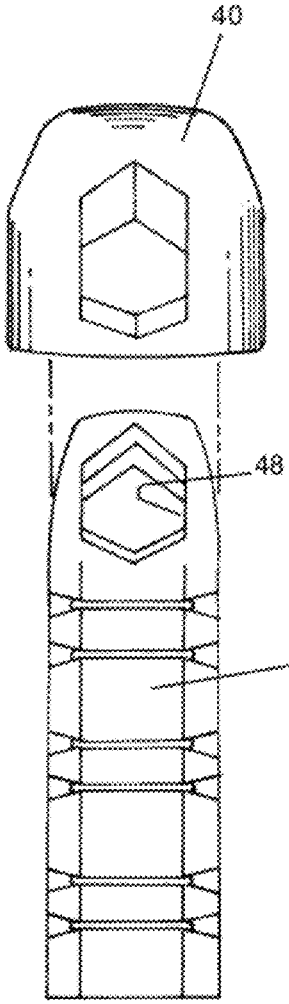
FIG. 5
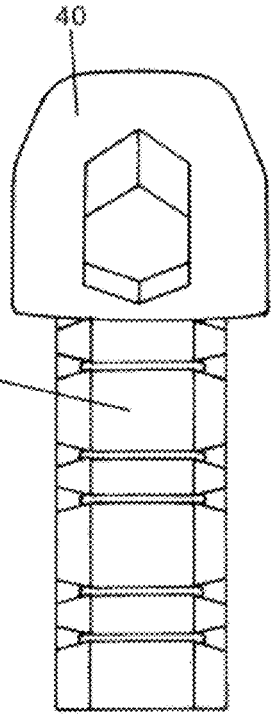
FIG. 6
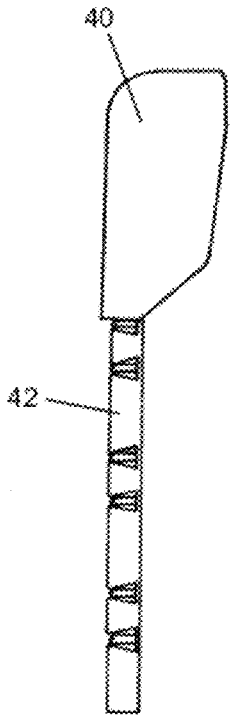
FIG. 7

LACROSSE GLOVE HAVING REINFORCED FINGERS

BACKGROUND

In sports in which players are subject to stick slashing, such as lacrosse and hockey, players typically wear padded gloves to protect their hands and wrists. These gloves usually include foam padding or other protective padding covering the back of a wearer's hand, fingers, and thumb. While this padding generally protects the back of a wearer's hands, the wearer's fingers and thumb may become somewhat exposed to contact when the glove is flexed into a gripping position. Furthermore, the padding may not always be sufficient to resist the hardest impacts in these sensitive regions. Thus, players may still be at risk of finger and thumb injuries, even when wearing a padded glove.

SUMMARY

A sports glove, such as a lacrosse or hockey glove, includes reinforced finger regions for protecting a wearer's fingers. The back side of each of the finger regions includes a reinforcing element or other protective feature. A thumb protector may optionally be attached to a thumb region of the glove to provide additional protection for a wearer's thumb, as well. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views:

FIG. 3 is a top perspective view of a thumb protector attached to a thumb reinforcing member, according to one embodiment.

FIG. 4 is a bottom perspective view of the thumb protector and thumb reinforcing member shown in FIG. 3.

FIG. 5 is a top view of the thumb protector removed from the thumb reinforcing member shown in FIG. 3.

FIG. 6 is a top view of the thumb protector and thumb reinforcing member shown in FIG. 3.

FIG. 7 is a side view of the thumb protector and thumb reinforcing member shown in FIG. 3.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
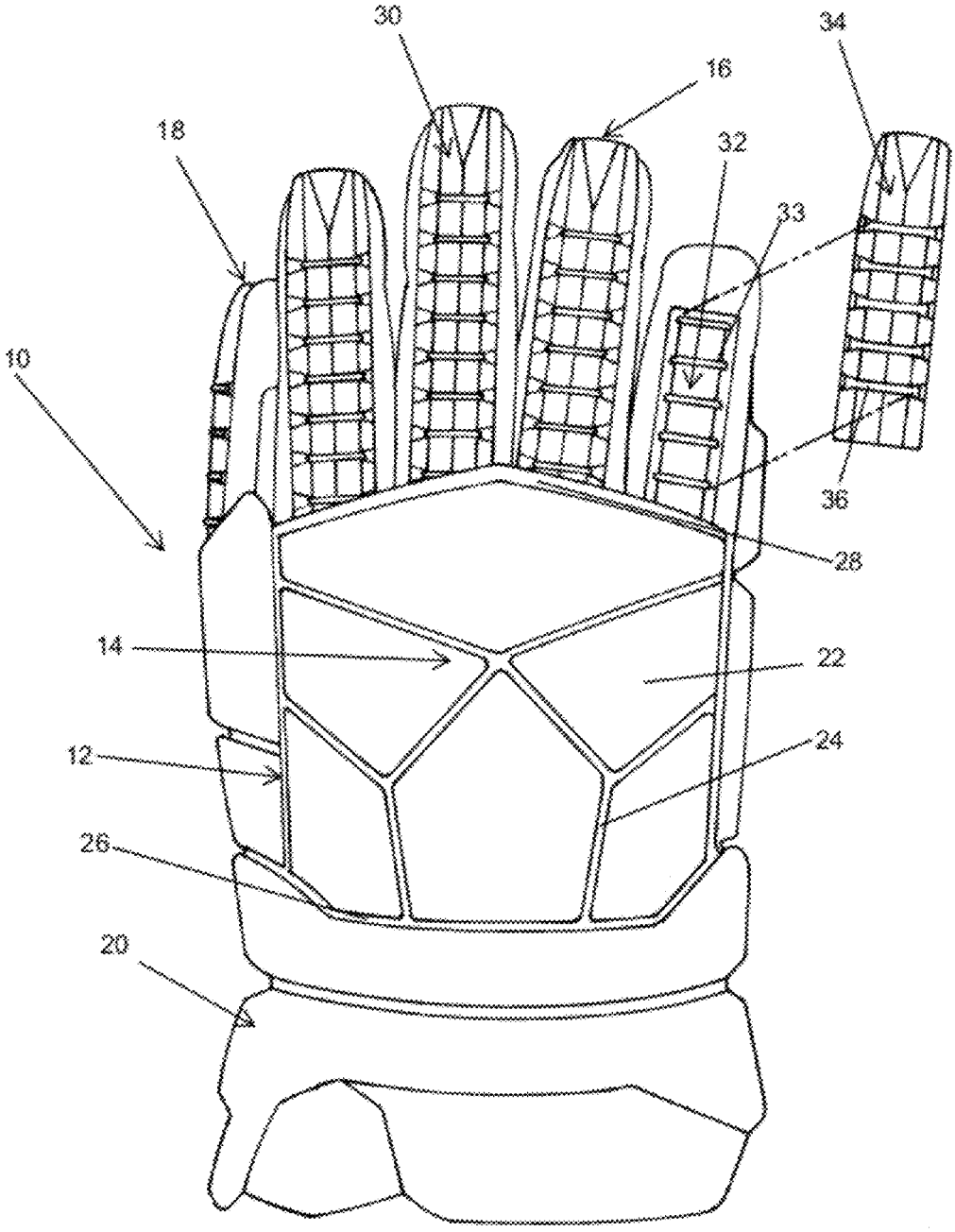
FIG. 1 is a rear perspective view of a sports glove with an outer casing removed from a finger reinforcing element, according to one embodiment.

Turning now in detail to the drawings, FIG. 1 illustrates a sports glove 10, according to one embodiment. The sports gloves described herein may be used in a variety of sports, including lacrosse, hockey, and other contact sports. For ease of description, these gloves will generally be referred to herein as sports gloves or lacrosse gloves.

The lacrosse glove 10 includes a main body 12 having a rear section 14. Multiple finger sections 16 configured to receive a wearer's fingers extend from a first end of the main body 12. A thumb section 18 configured to receive a wearer's thumb extends from a side region of the main body 12. The side regions of the finger sections 16 may include durable material (e.g., leather) or a breathable material (e.g., mesh). The palm section of the glove (not shown) opposite the rear section may include a durable material, and may optionally include openings or breathable material in one or more regions to provide ventilation to a wearer's hand.

A cuff region 20 extends from a second end of the main body 12. The cuff region 20 is optionally extendable such that the amount of wrist coverage it provides may be adjusted. The cuff region 20, for example, may be elastically attached to an interior of the main body 12 and may include hook and loop fasteners or other suitable attachment mechanisms to allow the cuff region 20 to be attached at a desired location on the inside of the main body 12.

The rear section 14 includes pads 22 made of an open cell, urethane foam (e.g., Poron®), a PVC nitrile foam, or another suitable impact-absorbing material. The pads 22 are preferably encased in a fabric material, such as nylon or another suitable material. Similar padding arrangements are preferably included on the rear surfaces of the finger sections 16 and the thumb section 18, as well. The various pads 22 on the rear section 14 are separated from one another by seams 24 that provide flexibility between the pads 22 when a wearer's hand is flexed. A cuff line 26 separates the rear section 14 from the cuff region 20, and a finger line 28 separates the rear section 14 from the finger sections 16, to provide flexibility between the respective regions.

Figure 2:
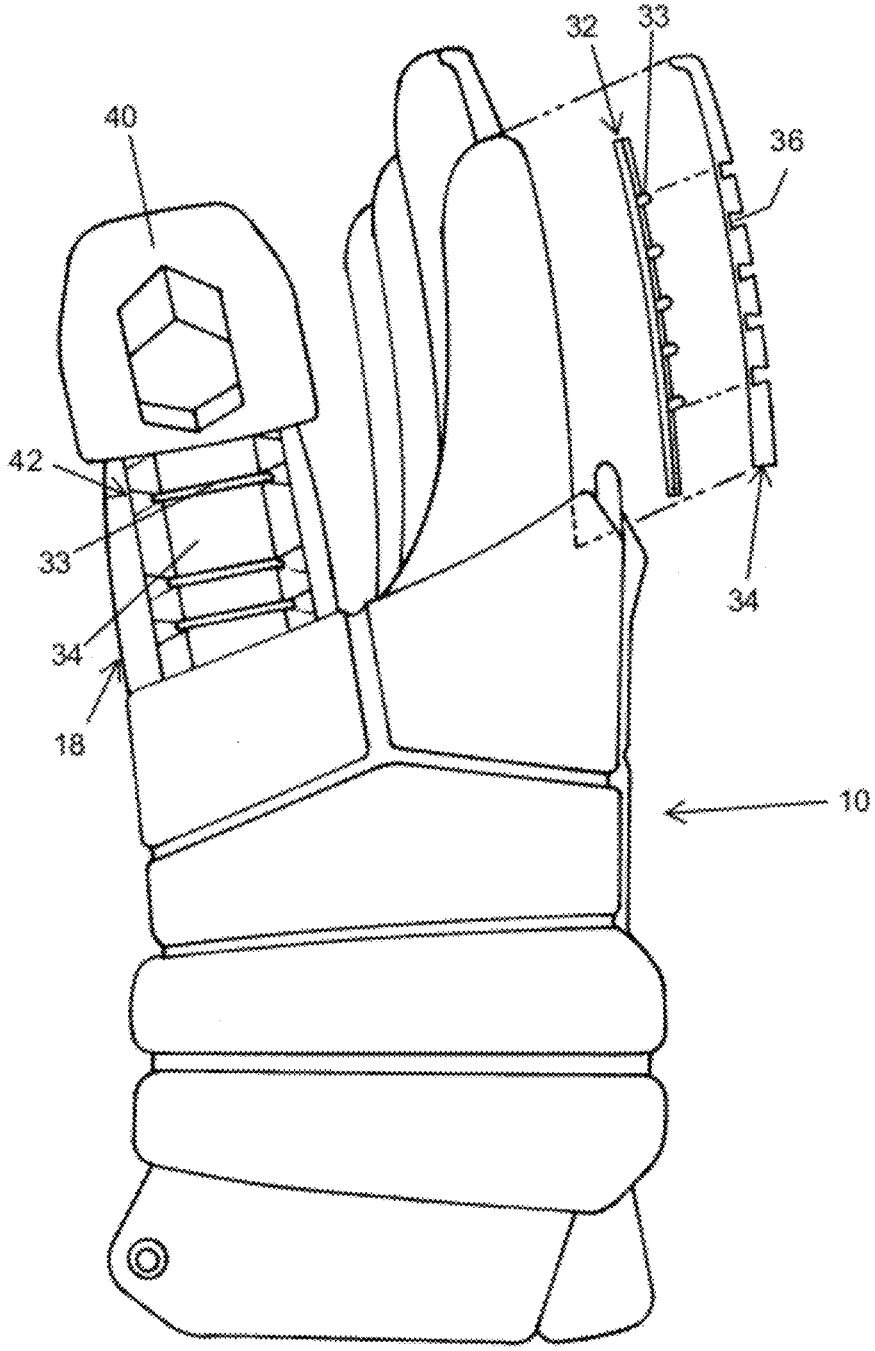
FIG. 2 is a side perspective view of a sports glove with an inner rib section and an outer casing removed from a finger portion, and with a thumb protector attached to a thumb region, according to one embodiment.

As shown in FIGS. 1 and 2, each finger section 16, and optionally the thumb section 18, includes a reinforcing element 30 attached to a rear surface of the finger section 16. In one embodiment, each reinforcing element 30 includes an inner rib section 32 and an outer casing 34.

The inner rib section 32 optionally includes a plurality of raised projections 33 for protecting a wearer's fingers from stick slashes and other hard impacts. The spacing between the projections 33 may optionally be greater on the thumb rib section to provide greater flexibility in the thumb section 18. The inner rib section 32 may be made of a plastic material (e.g., polyethylene), an elastomeric material, or another suitable material. An elastomeric material may be used to provide increased flexibility relative to a harder plastic material.

The outer casing 34 includes a plurality of openings 36 through which the projections 33 on the rib section 32 extend. The outer casing 34 is preferably made of a plastic material but could also be made of an elastomeric material or another material suitable for protecting the rear of a wearer's fingers from stick slashes and other hard impacts.

In one embodiment, each outer casing 34 is positioned over a corresponding inner rib section 32 and stitched to the rear of a finger section to hold the inner rib section 32 in place. The outer casing 34 may optionally include small holes around its periphery though which the stitching may pass. In one embodiment, the stitching is threaded through the fabric on the rear of the finger section 16 and into the inner padding to better secure the outer casing 34 to the finger section 16. Alternatively, the outer casing 34 or the inner rib section 32 may be adhesively attached or otherwise secured to the rear surface of the finger section 16.

In another embodiment, the reinforcing element 30 may include only one of the inner rib section 32 and the outer casing 34. For example, an outer casing 34, with or without openings 36, may be stitched or otherwise secured to the finger section 16 without including a corresponding rib section 32. Including only one of the inner rib section 32 and the outer casing 34 may provide increased flexibility relative to a multi-component reinforcing element 30.

As shown in FIGS. 2-7, a thumb protector 40 may optionally be attached to a reinforcing element 42 (which may be the same or different than the reinforcing elements 30 on the finger regions 16) on the rear of the thumb region 18. Lacrosse goalies, for example, are often subject to slashes to the thumb region, and therefore may desire the added protection. The thumb protector 40 may be made of a hard plastic material or other material suitable for protecting the rear of a wearer's thumb from stick slashes and other hard impacts. As shown in FIG. 4, an impact-absorbing foam liner 44 or other suitable material may optionally be adhered or otherwise attached to an inner surface of the thumb protector 40 to provide additional protection.

The thumb protector 40 may be removably or permanently attached to the thumb reinforcing element 42. In one embodiment, the thumb protector 40 includes a locking element 46 that engages the thumb reinforcing element 42 through an opening 48 in the thumb reinforcing element 42. The thumb protector 40 may alternatively attach to the thumb reinforcing element 42 (or the thumb region 18) via grooves in the thumb protector 40 that mate with the edges of the thumb reinforcing element 42, or via a snap-fitting mechanism. In one embodiment, the thumb protector 40 could be configured to fit over and surround the thumb region 18 such that it provides protection to all sides of the thumb.

The sports gloves described herein provide increased protection to the fingers and thumb against stick slashes and other hard impacts, while allowing sufficient flexibility for a wearer to grip a lacrosse stick, hockey stick, or other sporting good. Any of the above-described embodiments may be used alone or in combination with one another. Furthermore, the sports gloves may include additional features not described herein. While various embodiments have been shown and described, various changes and substitutions may of course be made, without departing from the spirit and scope of the invention. The invention, therefore, should not be limited, except by the following claims and their equivalents.

What is claimed is:

1. A sports glove, comprising:

a main body including a palm region and a rear region opposite the palm region;

a plurality of finger portions extending from the main body, with each finger portion including a rear finger region; and a reinforcing member on the rear finger region of each of the finger portions, wherein the reinforcing member includes:

an inner rib section positioned against the rear finger region; and an outer casing overlying the inner rib section, wherein the outer casing includes a plurality of openings, and the inner rib section includes a plurality of projections extending through the openings.

2. The sports glove of claim 1 wherein the outer casing is stitched to the rear finger region such that it secures the inner rib section to the rear finger region.

3. The sports glove of claim 1 wherein the inner rib section comprises a plastic material.

4. The sports glove of claim 1 wherein the inner rib section comprises an elastomeric material.

5. The sports glove of claim 1 wherein the outer casing comprises a plastic material.

6. The sports glove of claim 1 wherein the rear region of the main body includes an impact-absorbing padding encased in a fabric material.

7. The sports glove of claim 1 further comprising a thumb portion extending from the main body, wherein a thumb reinforcing member is attached to a rear region of the thumb portion.

8. The sports glove of claim 7 further comprising a thumb protector attached to the thumb reinforcing member.

9. The sports glove of claim 8 wherein a layer of foam padding is attached to an interior region of the thumb protector.

10. The sports glove of claim 8 wherein the thumb protector includes a locking element that engages the thumb reinforcing member through an opening in the thumb reinforcing member.

11. The sports glove of claim 8 wherein the thumb protector comprises a plastic material.

12. The sports glove of claim 1 further comprises an adjustable cuff region elastically attached to an interior region of the main body.

13. A sports glove, comprising:

a main body including a palm region and a rear region opposite the palm region;

a plurality of finger portions extending from the main body, with each finger portion including a rear finger region;

a reinforcing member on the rear finger region of each of the finger portions, wherein each reinforcing member includes an inner rib section positioned against the rear finger region;

a thumb portion extending from the main body, with the thumb portion including a rear thumb region;

a thumb reinforcing member on the rear thumb region, wherein the thumb reinforcing member includes an inner rib section positioned against the rear thumb region; and an outer casing overlying each inner rib section, wherein each outer casing includes a plurality of openings, and the corresponding inner rib section includes a plurality of projections extending through the openings.

14. The sports glove of claim 13 further comprising a thumb protector attached to the thumb reinforcing member.

15. The sports glove of claim 14 wherein a layer of foam padding is attached to an interior region of the thumb protector.

16. A sports glove, comprising:

a main body including a palm region and a rear region opposite the palm region;

a thumb portion extending from the main body, with the thumb portion including a rear thumb region;

a thumb reinforcing member on the rear thumb region; and a substantially rigid thumb protector attached to the thumb reinforcing member, wherein the thumb protector includes a locking element that engages the thumb reinforcing member through an opening in the thumb reinforcing member.

17. The sports glove of claim 16 further comprising a layer of foam padding attached to an interior region of the thumb protector.

* * * * *